United States Patent [19]

Cox et al.

[11] B 3,993,215

[45] Nov. 23, 1976

[54] SPIRAL VENDOR

[75] Inventors: Robert N. Cox, Bridgeton; Kenneth G. Albers, Florissant, both of Mo.

[73] Assignee: UMC Industries, Inc., New York, N.Y.

[22] Filed: Sept. 30, 1974

[21] Appl. No.: 510,281

[44] Published under the second Trial Voluntary Protest Program on March 9, 1976 as document No. B 510,281.

[52] U.S. Cl. ..... 221/75
[51] Int. Cl.[2] ..... G07F 11/46
[58] Field of Search ..... 221/75, 261, 312

[56] References Cited

UNITED STATES PATENTS

| | | | |
|---|---|---|---|
| 3,335,907 | 8/1967 | Holstein et al. | 221/75 X |
| 3,441,174 | 4/1969 | Kenney | 221/75 |
| 3,469,738 | 9/1969 | Schuller | 221/75 |
| 3,601,281 | 8/1971 | Schlaf | 221/75 |
| 3,861,561 | 1/1975 | Wittern et al. | 221/75 |

*Primary Examiner*—Robert B. Reeves
*Assistant Examiner*—Francis J. Bartuska
*Attorney, Agent, or Firm*—Koenig, Senniger, Powers and Leavitt

[57] ABSTRACT

A rear-to-front spiral vendor having special provision for vending items such as bags of snack products, e.g., bags of potato chips, without hang-up of the items against the front window of the cabinet of the vendor.

10 Claims, 5 Drawing Figures

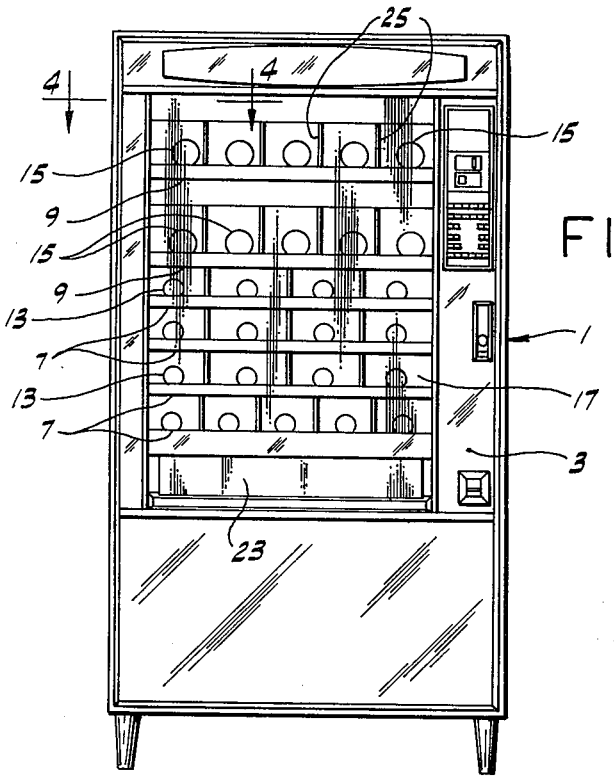
FIG. 1
FIG. 2
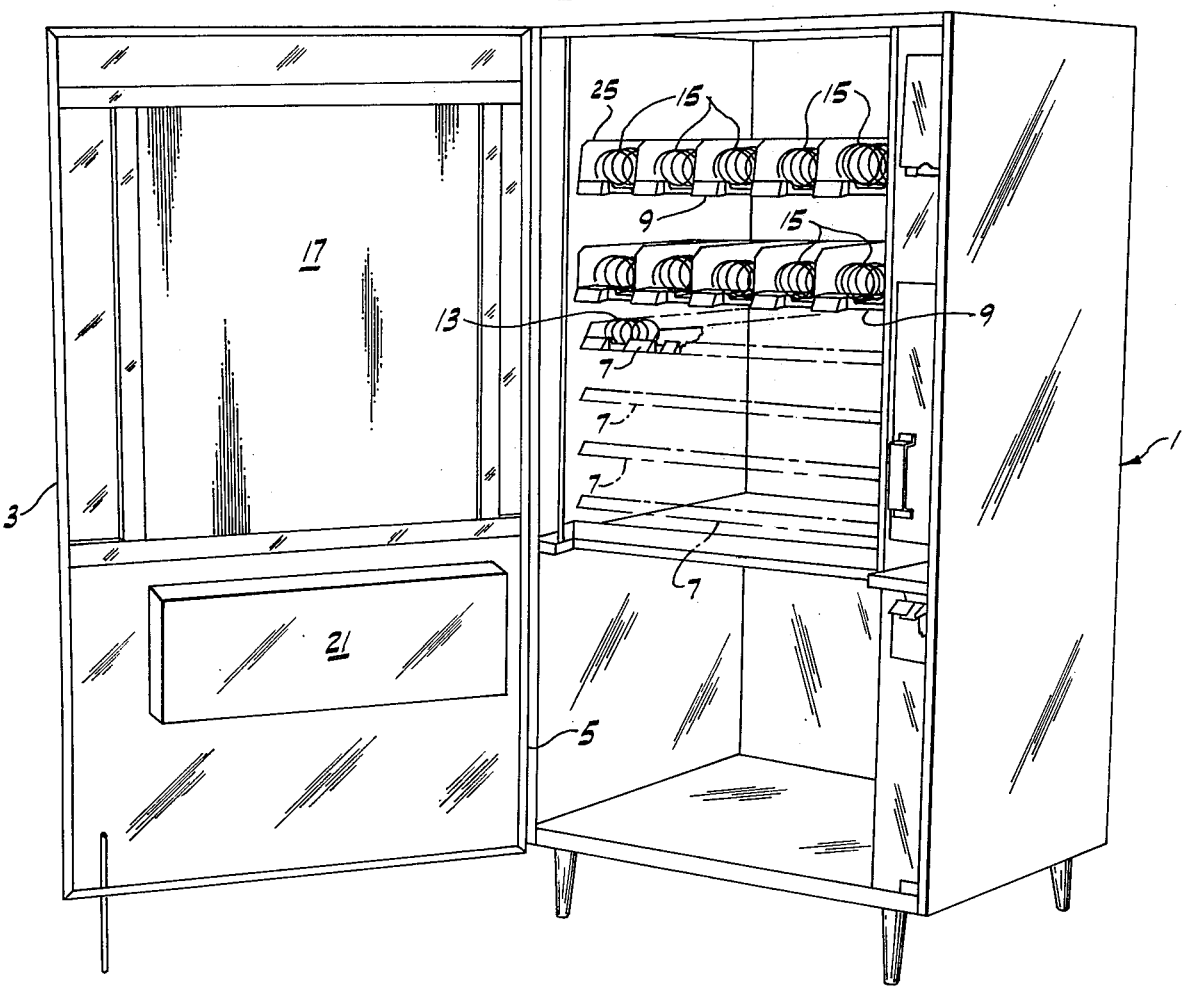

SPIRAL VENDOR

BACKGROUND OF THE INVENTION

This invention relates to spiral vendors, and more particularly to such vendors for vending so-called snack products including bags of potato chips, pretzels, and the like.

The invention is especially concerned with a spiral vendor of the rear-to-front type, such as shown in U.S. Pats. Nos. 3,178,055, 3,269,595, 3,344,953, 3,591,045, 3,653,540 and 3,773,217, comprising a cabinet having a front door, shelves in the cabinet having their forward ends spaced rearward from the door to provide a drop space, helices on the shelves extending in rear-to-front direction with respect to the cabinet and adapted to receive items to be vended between their convolutions, the door having a window for viewing the forwardmost items, and means for rotating each helix to advance the items in the convolutions of the helix toward the forward end of the respective shelf and discharge the forwardmost item off the forward end of the shelf to drop down in said drop space.

Rear-to-front spiral vendors such as above described have come into use for vending candy, gum and mints and so-called snack products, including bags of potato chips, pretzels and the like. A problem has been encountered in dispensing such bags in that in some instances the bags, instead of dropping, tip over and become bridged against the window of the vendor. This problem can be solved by increasing the distance between the window and the forward ends of the shelves to a dimension greater than the height of the bags and the problem has been so serious that this has been done, but it unduly increases the depth of the cabinet or, if the depth of the cabinet is not increased, reduces the capacity of the vendor.

SUMMARY OF THE INVENTION

Among the several objects of this invention may be noted the provision of an improved rear-to-front spiral vendor in which hang-up of items (such as bags of chips or pretzels) against the window of the vendor is substantially eliminated without increasing the depth of the cabinet or reducing the capacity of the vendor; and the provision of such a vendor in which the anti-hang-up feature involves little, if any, extra cost and is highly reliable for anti-hang-up of bags or other items to be vended.

In general, the invention involves the provision of a formation for the forward end of the shelf including a notch at the forward end of the shelf and a forwardly projecting ledge at one side of the notch, the helix at its forward end extending over the notch and having an at-rest position wherein its forwardmost convolution has a lower portion extending over the notch to support the forwardmost item at one side thereof above the notch with the other side of the item supported on said ledge, said lower portion being withdrawn from under said item when said helix is rotated to discharge said forwardmost item.

Other objects and features will be in part apparent and in part pointed out hereinafter.

BRIEF DESCRIPTION OF THE DRAWINGS

FIG. 1 is a front elevation of a vendor of this invention;

FIG. 2 is a perspective of the vendor with its front door open;

Corresponding reference characters indicate corresponding parts throughout the several views of the drawings.

DESCRIPTION OF THE PREFERRED EMBODIMENT

Figure 3:
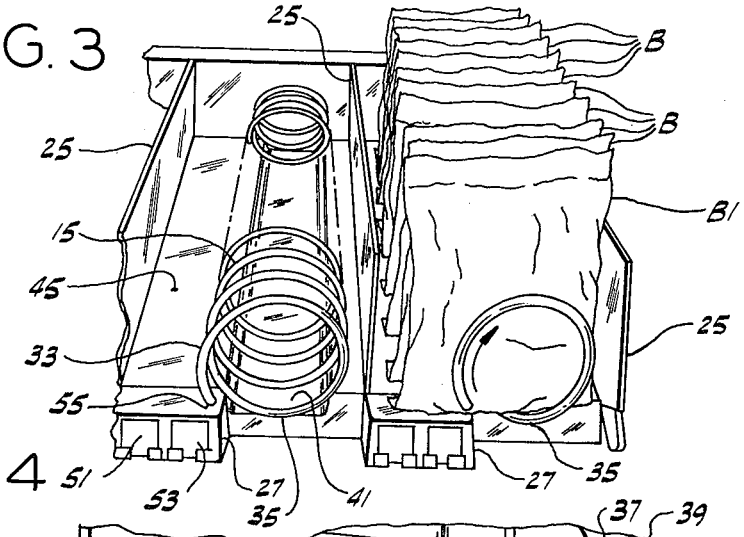
FIG. 3 is a perspective showing part of a shelf and two of the helices on the shelf, with bags in the convolutions of the helix at the right.

Referring to the drawings, a vendor incorporating the present invention is shown generally to comprise a cabinet 1 having a front door 3 hinged at the left as indicated at 5. Within the cabinet there are a plurality of shelves or trays, one above another. As shown there are six shelves, of which the four lower shelves, each designated 7, are for dispensing candy, gum and mints and the upper two shelves, each designated 9, are for dispensing snacks. Generally, the term "snack" refers to a bagged item such as chips (e.g., potato chips), pretzels and the like; "candy" refers to candy bars; and "mints" refers to roll type packages of mints. Each shelf is slidable into and out of the cabinet and, when slid into the cabinet, has an operative position wherein its forward end is spaced rearward from the door 3 to provide a drop space 11. Each shelf has a plurality of helices thereon, each helix extending in rear-to-front direction with respect to the cabinet. Each helix on each of the shelves 7 is designated 13 and is adapted to receive candy, gum or mints between its convolutions. Each helix on each of the shelves 9 is designated 15. It is adapted to receive items B to be vended, such as bags of chips, between its convolutions. The door 5 has a window 17 for viewing the forwardmost items. Means indicated at 19 is provided for rotating each helix to advance the items loaded between its convolutions toward the forward end of the respective shelf and discharge the forwardmost item off the forward end of the shelf to drop down in said drop space 11 to a delivery pan 21 from which it may be taken out by the customer by pushing in a delivery door 23 in the door 3 below the window 17. Each shelf also has guides 25 extending in rear-to-front direction at opposite sides of each helix defining a rear-to-front path of travel for the items loaded between the convolutions of the helix.

This invention is concerned only with the two upper shelves 9 for snacks. Generally, in accordance with this invention, the forward end of each of these shelves 9 is of special formation, including a notch 27 in line with each helix 15 on the shelf and a forwardly projecting ledge 29 at one side of the notch. The notch is open at the forward end of the shelf and extends rearwardly from the forward end of the shelf. It is offset toward one side (the right side as viewed in FIGS. 3–5) of the path of travel of the items defined by the guides 25. The ledge 29 is offset toward the other side of said path. The helix 15 extends forward beyond the rear edge 31 of the notch over the notch. It has an at-rest position (FIGS. 3–5) wherein its forwardmost convolution 33 has a lower portion 35 extending over the notch to support the forwardmost item B1, by its bottom at one side thereof, with the item supported by its bottom at the other side thereof on the ledge. The helix rotates in clockwise direction as viewed in FIG. 3, and the lower portion 35 of the forwardmost convolution 33 of the helix is withdrawn from under the item B1 when the helix is rotated in said direction to discharge item B1 from the forward end of the shelf to drop down in the space 11.

More particularly each of the snack shelves 9 comprises spaced upper and lower sheet metal plates 37 and 39. The upper plate is formed with relatively wide, shallow flat-bottomed channels or troughs 41 extending in rear-to-front direction, one for each of the helices 15 on the shelf. Each helix comprises a coil of somewhat larger diameter than the width of the channel 41, and is seated in the channel with its convolutions generally engaging the edges 43 of the upper plate at the sides of the channel for holding the helix against lateral displacement. The guides 25 are constituted by sheet metal panels extending up from the upper plate on opposite sides of each helix. Preferably, as appears in FIGS. 3–5, as to each helix, the guide 25 at the right of the helix is relatively close to the right side of the helix, and the guide 25 at the left of the helix is relatively widely spaced from the left side of the helix. Thus, the helix is relatively widely spaced from the left-hand guide 25 and extends relatively closely adjacent the right-hand guide 25, thereby providing a relatively wide portion 45 of the shelf between the left-hand guide and the helix for supporting the bags B at the left of the helix. There is also a relatively narrow portion 47 of the shelf between the right-hand side of the helix and the right-hand guide 25.

The ledges 29 project forwardly from portions 45 of the shelf in extension thereof. Each notch extends widthwise of the shelf from the ledge on its left generally to the plane of the guide 25 on its right, and has a depth (i.e., its dimension in rear-to-front direction) at least of the order of the pitch of the helix. The front of each ledge is formed with recesses such as indicated at 49 for holding product number tags 51 and price tags 53.

As shown best in FIG. 3, in the at-rest position of a helix 15, its forward end 55 is above and closely adjacent the extreme right-hand side of the respective ledge 29 toward the front of the ledge. The forwardmost bag B1 lies between the forwardmost convolution of the helix and the next convolution usually at a slight angle with respect to the vertical plane of the front of the ledges 29, seated at the left on the ledge 29. The remaining bags B lie between convolutions of the helix rearward of the forwardmost bag. Upon a vending cycle, the helix is rotated through a single revolution in clockwise direction as viewed in FIG. 3 (and as indicated by the arrow therein) from its at-rest position of FIG. 3 back to its at-rest position. As it rotates, the forwardmost convolution moves away from in front of the item B1, the end 55 of the helix travelling up and around toward the right and then down and around toward the left back to its at-rest position as viewed in FIG. 3. As this movement progresses, the bag B1 is advanced forward by the augering action of the helix, in such manner that the left-hand side of the bag slides forward off the forward end of the ledge 29. Generally, after the left-hand side of the bag has been moved forward off the ledge, the bag is supported at its right-hand side on the lowermost portion 35 of the forwardmost convolution until the end 55 of the helix has travelled around far enough to permit the bag to tilt to the left on said lowermost portion and drop off and fall in the drop space 11, either somewhat before or when the lowermost portion is wholly withdrawn from underneath the right side of the bag. The action may vary depending on various factors including the size and shape of the bag, but, in any event, is generally such that the bag will drop without hanging up against the window 17.

Figure 4:
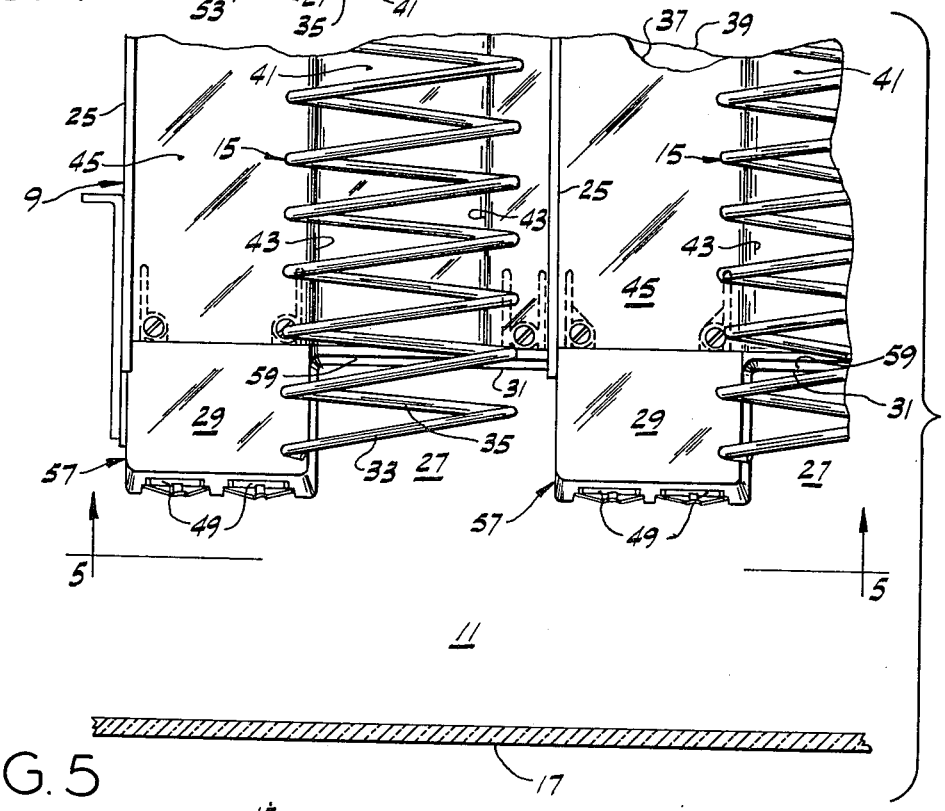
FIG. 4 is an enlarged fragmentary horizontal section on line 4—4 of FIG. 1.
Figure 5:
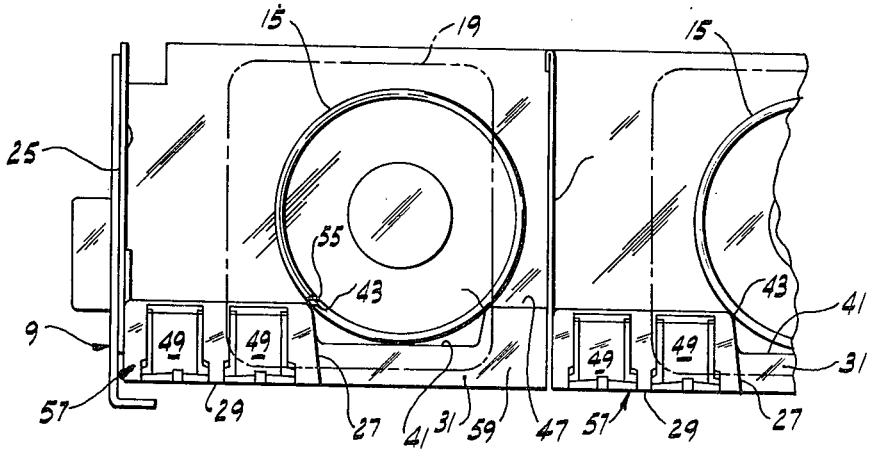
FIG. 5 is a view in elevation of the front of a shelf taken on line 5—5 of FIG. 4.

In respect to the helix shown in FIG. 4, the depth of the notch 27 is about twice the pitch of the helix. This is to enable use of helices with a greater pitch on the same shelf. Generally, the depth of the notch is preferably at least of the order of the pitch of the helix, and the shelf shown in FIG. 4 is adapted to take helices with a pitch up to twice that shown for the helices 15.

The notches 27 and ledges 29 are provided by the securement in suitable manner of molded plastic members 57 at the front of the shelf, each member 57 having a portion forming the ledge 29 with the tag recesses 49 at its front and a narrow tongue 59 forming a front between the upper and lower plates 37 and 39 of the shelf at the rear of the notch.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In a vendor comprising a cabinet having a front door, at least one shelf in the cabinet, the forward end of the shelf being spaced rearward from the door to provide a drop space, a helix on the shelf extending in rear-to-front direction with respect to the cabinet and adapted to receive items to be vended between its convolutions, the items being wider than the diameter of the helix, the helix being interiorly unobstructed so that the items may be received between its convolutions extending across the helix from one side thereof to the other, the door having a window for viewing the forwardmost item, means for rotating the helix to advance the items toward the forward end of the shelf and discharge the forwardmost item off the forward end of the shelf to drop down in said drop space, and guides extending in rear-to-front direction on the shelf at opposite sides of the helix defining a path of travel for said items, the improvement comprising the provision of a formation for the forward end of the shelf including a notch at the forward end of the shelf and a forwardly projecting ledge at one side of the notch, the notch being open at the forward end of the shelf and extending rearwardly from the forward end of the shelf, and being offset toward one side of the path of travel of the items defined by said quides, the ledge being offset toward the other side of said path, the helix at its forward end extending over the notch and having an at-rest position wherein its forwardmost convolutions has a lower portion extending over the notch to support the forwardmost item at one side thereof above the notch with the other side of the item supported on said ledge, said lower portion rotating in the direction for withdrawal from under said item when said helix is rotated to discharge said forwardmost item.

2. In a vendor as set forth in claim 1, the guides being spaced a distance to accommodate the width of items to be dispensed, the guides being so located relative to the helix that the helix is relatively widely spaced from one guide and extends relatively closely adjacent the other, thereby providing a relatively wide portion of the shelf between said one guide and the helix for supporting items at the said other side thereof, said ledge projecting forwardly from said relatively wide portion of the shelf in extension thereof.

3. In a vendor as set forth in claim 2, said notch extending widthwise of the shelf from the ledge generally to the plane of said other guide.

4. In a vendor as set forth in claim 3, the notch having a depth at least of the order of the pitch of the helix.

5. In a vendor comprising a cabinet having a front door, at least one shelf in the cabinet for snacks, the forward end of the shelf being spaced rearward from the door to provide a drop space, a plurality of helices on the shelf extending in rear-to-front direction with respect to the cabinet each adapted to receive snacks to be vended bewteen its convolutions, the snacks being wider than the diameter of the helices, each helix being interiorly unobstructed so that snacks may be received between its convolutions extending across the helix from one side thereof to the other, the door having a window for viewing the forwardmost snacks, means for rotating each helix to advance the respective snacks toward the forward end of the shelf and discharge the respective forwardmost snack off the forward end of the shelf to drop down in said drop space, guides extending in rear-to-front direction on the shelf at opposite sides of each helix defining paths of travel for the snacks loaded in the convolutions of the helices, the improvement comprising the provision of a formation for the forward end of the shelf including a notch at the forward end of each helix and a forwardly projecting ledge at one side of each notch, the notch being open at the forward end of the shelf and extending rearwardly from the forward end of the shelf, and being offset toward one side of the path of travel of the snacks defined by said guides, the ledge being offset toward the other side of said path, each helix at its forward end entending over the respective notch and having an at-rest position wherein its forwardmost convolution has a lower portion extending over the notch to support the respective forwardmost snack at one side thereof above the notch with the other side of the snack supported on said ledge, said lower portion rotating in the direction for withdrawal from under said forwardmost snack when the helix is rotated to discharge said forwardmost snack.

6. In a vendor as set forth in claim 5, the guides for each helix being so located relative to the helix that the helix is relatively widely spaced from one guide and extends relatively closely adjacent the other, thereby providing a relatively wide portion of the shelf between said one guide and the helix for supporting items at the said other side thereof, said ledges projecting forwardly from said relatively wide portions of the shelf in extension thereof, the notches being between said ledges.

7. In a vendor as set forth in claim 6, the ledge for each helix extending widthwise of the shelf generally from the plane of the said one guide for said helix to the respective side of the helix.

8. In a vendor as set forth in claim 7, the shelf having channels for the helices extending from rear-to-front of the shelf.

9. In a vendor as set forth in claim 6, each helix having an at-rest position from which it is rotatable through a single revolution to discharge said forwardmost snack and in which the forward end of the helix when at rest is adjacent the side of the ledge toward the notch and is movable up and around and then down and back to its at-rest position.

10. In a vendor as set forth in claim 9, each ledge being at the left of its respective helix and each helix being rotatable clockwise as viewed from the front.

* * * * *